US008287086B2

(12) United States Patent
Sakurai

(10) Patent No.: US 8,287,086 B2
(45) Date of Patent: Oct. 16, 2012

(54) IMAGE RECORDING APPARATUS AND METHOD FOR RESTORING RECORDING HEAD FOR IMAGE RECORDING APPARATUS

(75) Inventor: Hisaki Sakurai, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 407 days.

(21) Appl. No.: 11/977,236

(22) Filed: Oct. 24, 2007

(65) Prior Publication Data

US 2008/0094444 A1 Apr. 24, 2008

(30) Foreign Application Priority Data

Oct. 24, 2006 (JP) ..... 2006-288513

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS

| | | | | |
|---|---|---|---|---|
| 5,572,242 | A * | 11/1996 | Fujii et al. | 347/23 |
| 5,819,013 | A | 10/1998 | Miyazaki et al. | |
| 5,940,185 | A * | 8/1999 | Inoue et al. | 358/296 |
| 6,185,603 | B1 * | 2/2001 | Henderson et al. | 709/206 |
| 6,195,173 | B1 * | 2/2001 | Kato | 358/1.16 |
| 6,398,336 | B1 * | 6/2002 | Yoda et al. | 347/23 |
| 6,676,236 | B1 * | 1/2004 | Uchikata | 347/5 |
| 6,764,159 | B2 * | 7/2004 | Endo | 347/19 |
| 7,029,086 | B2 * | 4/2006 | Satake et al. | 347/14 |
| 2004/0227970 | A1 | 11/2004 | Ohara | |

FOREIGN PATENT DOCUMENTS

| | | |
|---|---|---|
| EP | 1591262 | 2/2005 |
| JP | H06-164805 | 6/1994 |
| JP | 9116665 | 5/1997 |
| JP | H11-20196 | 1/1999 |
| JP | 2000-32175 | 1/2000 |
| JP | 2000218905 | 8/2000 |

(Continued)

OTHER PUBLICATIONS

Notice of Decision of Refusal and English Translation for Japanese Patent application No. 2006-288513 dated Mar. 7, 2012.

(Continued)

*Primary Examiner* — Matthew Luu
*Assistant Examiner* — Alejandro Valencia
(74) *Attorney, Agent, or Firm* — Frommer Lawrence & Haug LLP

(57) ABSTRACT

If any change, which appears on a display for displaying the situation of the operation, is detected, it is judged whether or not an elapsed time, which elapses from the previous execution of the restoring operation for the discharge state of nozzles, exceeds a predetermined time period. If the elapsed time exceeds the predetermined time period, the control is made by a controller so that the restoring operation is executed for the recording head. The restoring operation is executed before the instruction of the recording operation for a recording medium in a multi function device which has various functions including, for example, the copy function, the facsimile function, the scanner function, and the printer function in combination and which is provided with the functions in a multifunctional manner. Therefore, the waiting time for a user, which is required until the completion of the recording, can be shortened.

12 Claims, 9 Drawing Sheets

FOREIGN PATENT DOCUMENTS

| | | |
|---|---|---|
| JP | 2000229405 | 8/2000 |
| JP | 2001345959 | 12/2001 |
| JP | 2002-187329 | 7/2002 |
| JP | 2002187329 | 7/2002 |
| JP | 2002-344683 | 11/2002 |
| JP | 2002344683 | 11/2002 |
| JP | 2004152140 | 5/2004 |
| JP | 2004358963 | 12/2004 |
| JP | 2005165801 | 6/2005 |
| JP | 2005-238710 | 9/2005 |
| JP | 2005238710 | 9/2005 |
| JP | 2005313440 | 11/2005 |
| JP | 2006-27141 | 2/2006 |
| JP | 2006201868 | 8/2006 |
| JP | 2006251190 | 9/2006 |
| JP | 2006027141 | 2/7006 |

OTHER PUBLICATIONS

Inquiry Regarding Appeal for Japanese Patent Application No. 2006-288513 dated Jul. 31, 2012.

* cited by examiner

Fig. 7

| | NUMBER OF TIMES OF PURGING |
|---|---|
| 5 DAYS < T ≤ 10 DAYS | ONCE |
| 10 DAYS < T ≤ 15 DAYS | TWICE |
| 15 DAYS < T | THREE TIMES |
| IF INSTRUCTION IS MADE BY USER | ONCE |

IMAGE RECORDING APPARATUS AND METHOD FOR RESTORING RECORDING HEAD FOR IMAGE RECORDING APPARATUS

CROSS REFERENCE TO RELATED APPLICATION

The present application claims priority from Japanese Patent Application No. 2006-288513, filed on Oct. 24, 2006, the disclosure of which is incorporated herein by reference in its entirety.

BACKGROUND OF THE INVENTION

1. Field of the Invention

The present invention relates to an image recording apparatus provided with a recording section which records an image by discharging an ink from nozzles to a recording medium and a method for restoring a recording head for the image recording apparatus.

2. Description of the Related Art

A restoring mechanism, which maintains the satisfactory discharge state of nozzles, has been hitherto provided in some cases for a printer apparatus based on the ink-jet system which performs the recording by discharging the ink from the nozzles, as well as for an image recording apparatus of the multi function type provided with, for example, the copy function, the facsimile function, and the scanner function in combination in addition to the above.

The restoring mechanism is provided with, for example, a pump, and any viscous ink, any dried ink, bubbles and the like are removed by forcibly discharging the ink contained in the recording head. On the other hand, the restoring mechanism is provided with a wiper, and any ink adhered to the nozzle surface of the recording head is wiped out. Further, the ink contained in the recording head is forcibly discharged to the outside by driving the recording head irrelevant to the recording operation, and thus the ink discharge state is maintained to be satisfactory. In general, the elapsed time is measured from the previous execution of the restoring operation. When the recording operation is performed, if the elapsed time exceeds a predetermined elapsed time, then the restoring operation is performed automatically. Of course, if a user requires the restoring operation, the restoring operation can be also performed by instructing the restoring operation, for example, by means of the operation of the button irrelevant to the elapsed time.

However, in the case of the apparatus as described above, when the user intends to record the image on the recording medium, and the user instructs the recording operation, if the predetermined period of time has already elapsed after performing the previous restoring operation, then the restoring operation is firstly executed prior to the recording operation. Therefore, the waiting time is increased until the completion of the recording operation, and the user feels the inconvenience in many cases.

In view of the above, for example, an image forming apparatus (copy machine or multi function device having the copy function), in which a manuscript is read to perform the recording on the recording medium, is described in Japanese Patent Application Laid-open No. 2005-238710 (see FIGS. 4 and 6). In this apparatus, the operation, which is performed by a user prior to the reading of the manuscript, is judged as the operation before the instruction of the recording operation. The restoring operation is performed, if necessary, before starting the recording operation.

In particular, the restoring operation is performed from motives of the fact that the cover of the manuscript stand for placing the manuscript thereon is opened, the fact that the size of the recording medium is set, the fact that the number of sheets to be recorded is set, and/or the fact that the manuscript is set to an automatic document feeder (ADF). Accordingly, the period of time, which is required until the completion of the recording operation after the reading of the manuscript, is shortened as compared with a case in which the restoring operation is executed after the recording operation is instructed (copy button is depressed).

However, in recent years, as described above, the multi function device or apparatus, which is provided with not only the copy function but also various functions including, for example, the facsimile function, the scanner function, and the printer function in combination in a multifunctional manner, is gradually versatily used. In the case of the multi function device as described in Japanese Patent Application Laid-open No. 2005-238710 (see FIGS. 4 and 6), the restoring operation cannot be performed before the recording operation in any function other than the copy function.

SUMMARY OF THE INVENTION

An object of the present invention is to shorten the waiting time for the user until the completion of the recording. In the present invention, when a restoring operation is required for the nozzles, the restoring operation is executed in advance before the recording operation by detecting the operation to be performed prior to the recording operation. The present invention is applicable to a multi function device which is provided with, in combination, not only the copy function but also various functions including, for example, the facsimile function, the scanner function, and the printer function in a multifunctional manner.

According to a first aspect of the present invention, there is provided an image recording apparatus which records an image on a recording medium; the image recording apparatus including a recording section which records the image by discharging an ink from nozzles to the recording medium; an operating section, via which a user can select a desired operation from a plurality of operations including a recording operation to be performed by the recording section; a display which displays a situation of the operation; a restoring mechanism which performs a restoring operation for restoring a discharge state of the nozzles; a timer which measures an elapsed time elapsed after execution of the restoring operation last time; a detecting section which detects an event causing change in the display; and a controller which controls the restoring mechanism to execute the restoring operation when the event is detected by the detecting section and the elapsed time measured by the timer exceeds a predetermined time period.

According to the first aspect of the present invention, when the event, which causes the change in the display, is detected by the detecting section, if the elapsed time, which is measured by the timer, exceeds the predetermined time period, then the controller controls the restoring mechanism to immediately execute the restoring operation. That is, the event, which causes the change in the display, is detected as a sign or omen of the instruction of the recording operation. If the restoring operation is required at that time, the restoring operation is immediately executed before the recording operation is instructed. Accordingly, the waiting time for the user can be shortened until the completion of the recording as compared with a case in which the restoring operation is performed after the recording operation is instructed. It is possible to eliminate the inconvenience of the user. Further, the restoring operation can be previously performed before the recording operation accompanied by respective functions is performed even in the case of the a multi function device which has various functions including not only the copy function but also the facsimile function, the scanner function, the printer function and the like in combination and which is provided with the functions in a multifunctional manner. Therefore, the waiting time for the user can be shortened until the completion of the recording.

In the image recording apparatus of the present invention, the detecting section may detect an event which causes change in a display content of the display. In this arrangement, the display command, which changes the display content of the display device, is detected as the sign of the instruction of the recording operation. Therefore, the restoring operation can be quickly executed before the recording operation is instructed. It is possible to shorten the waiting time for the user until the completion of the recording.

In the image recording apparatus of the present invention, the image recording apparatus may further include a communication section which transmits and receives facsimile data, and when the facsimile data is received, the display content of the display may be changed to display a receipt of the facsimile data or to display the received facsimile data. According to the image recording apparatus of the present invention, when the facsimile data is received by the communication section, then the fact that the facsimile data is received is once displayed on the display device, or the content of the received facsimile data is displayed depending on the setting of the facsimile function. That is, when the facsimile data is received, the data is not immediately recorded on the recording medium by the recording section. Before the recording, the display content of the display is automatically changed into the display content as described above from the previous display content. After the facsimile data is received, or when the user confirms the display content of the display, there is a large possibility that the recording operation may be executed. Therefore, when the restoring operation is executed at the stage at which the display content of the display is changed therebefore, it is possible to shorten the waiting time for the user until the completion of the recording.

In the image recording apparatus of the present invention, a background color may be changed on the display to display the receipt of the facsimile data.

In the image recording apparatus of the present invention, the image recording apparatus may further include an external input terminal to which a storage medium is installable, image data or the like being stored in the storage medium, and when the storage medium is installed to the external input terminal, the display content may be changed to display an installation of the storage medium or to display the image data stored in the storage medium. In this arrangement, when the storage medium is installed to the external input terminal, then the fact that the storage medium is installed is once displayed on the display device, or the image data recorded in the storage medium is displayed. That is, when the storage medium is installed to the external input terminal, the display content of the display is changed. Usually, when it is intended to record the image data or the like of the storage medium on the recording medium, then the user installs the storage medium to the external input terminal, and the recording operation is instructed in order that the image data is recorded in succession. Therefore, when the restoring operation is executed at the stage at which the display content of the display is changed therebefore, it is possible to shorten the waiting time for the user until the completion of the recording.

In the image recording apparatus of the present invention, the display may be a display panel which is provided so that an angle thereof is adjustable with respect to the image recording apparatus and which displays a situation of the operation; and the detecting section may detect that the angle of the display panel with respect to the image recording apparatus is adjusted. In this arrangement, the fact that the angle of the display panel with respect to the apparatus is adjusted is detected as a sign of the instruction of the recording operation. The execution of the angle adjustment of the display panel with respect to the apparatus can be judged such that the user adjusts the display panel so that the panel is viewed easily, and the user intends to execute the next operation such as the recording operation while viewing the display content of the display panel. Therefore, it is possible to shorten the waiting time for the user until the completion of the recording, because it is detected that the angle of the display panel with respect to the apparatus is adjusted, and the restoring operation is immediately executed before the recording operation is instructed if the restoring operation is required.

In the image recording apparatus of the present invention, the restoring mechanism may adjust the restoring operation depending on a length of the elapsed time measured by the timer. In this arrangement, the restoring operation can be controlled depending on the length of the elapsed time measured by the timer. Accordingly, when the elapsed time is short, any unnecessary ink is not consumed in the restoring operation. On the other hand, when the elapsed time is long, it is possible to sufficiently restore the recording head.

In the image recording apparatus of the present invention, the restoring mechanism may include a pump which sucks the ink from the nozzles of the recording section, and a cap which covers the nozzles.

In the image recording apparatus of the present invention, the restoring operation may be adjusted by a number of times of suction of the ink from the nozzles of the recording section. Alternatively, the restoring operation may be adjusted by a length of time period of suction of the ink from the nozzles of the recording section.

In the image recording apparatus of the present invention, the restoring operation may include a sucking restoring operation for the recording section, and an operation for driving the recording section irrelevant to the recording operation to discharge the ink. Further, the sucking restoring operation may include an operation in which a nozzle surface formed in the recording section is wiped out by moving the recording section relatively with respect to a wiper for wipes the nozzle surface.

In the image recording apparatus of the present invention, the operating section may include a button via which the user selects or sets the operation of the image recording apparatus. Further, the operation of the image recording apparatus may include the restoring operation for the recording section.

According to a second aspect of the present invention, there is provided a method for restoring a recording head for an image recording apparatus, the method comprising: executing a restoring operation for the recording head; measuring an elapsed time elapsed after the execution of the restoring operation; detecting an event causing change in a display provided for the image recording apparatus; comparing the elapsed time with a predetermined time period when the event is detected; and executing the restoring operation if the elapsed time exceeds the predetermined time period.

According to the second aspect of the present invention, the restoring operation is executed when the event, which causes the change in the display, is detected as a sign or omen of the instruction of the recording operation and when the elapsed time elapsed after execution of the restoring operation last time exceeds the predetermined time period. Accordingly, the waiting time for the user can be shortened until the completion of the recording as compared with a case in which the restoring operation is performed after the recording operation is instructed.

In the method for restoring the recording head for the image recording apparatus, the event may cause change in a display content of the display.

In the method for restoring the recording head for the image recording apparatus, the event may be change of an angle of the display with respect to the image recording apparatus.

In the method for restoring the recording head for the image recording apparatus, the restoring operation may be adjusted depending on a length of the elapsed time measured by the timer.

BRIEF DESCRIPTION OF THE DRAWINGS

FIG. 7 illustrates a table stored in ROM.

DESCRIPTION OF THE PREFERRED EMBODIMENTS

An explanation will be made below about a most preferred embodiment in which the present invention is embodied. In this embodiment, the present invention is applied to a multi function device 1 (MFD: Multi Function Device) provided with the printer function, the copy function, the scanner function, and the facsimile function as one embodiment of the image recording apparatus.

Figure 6:
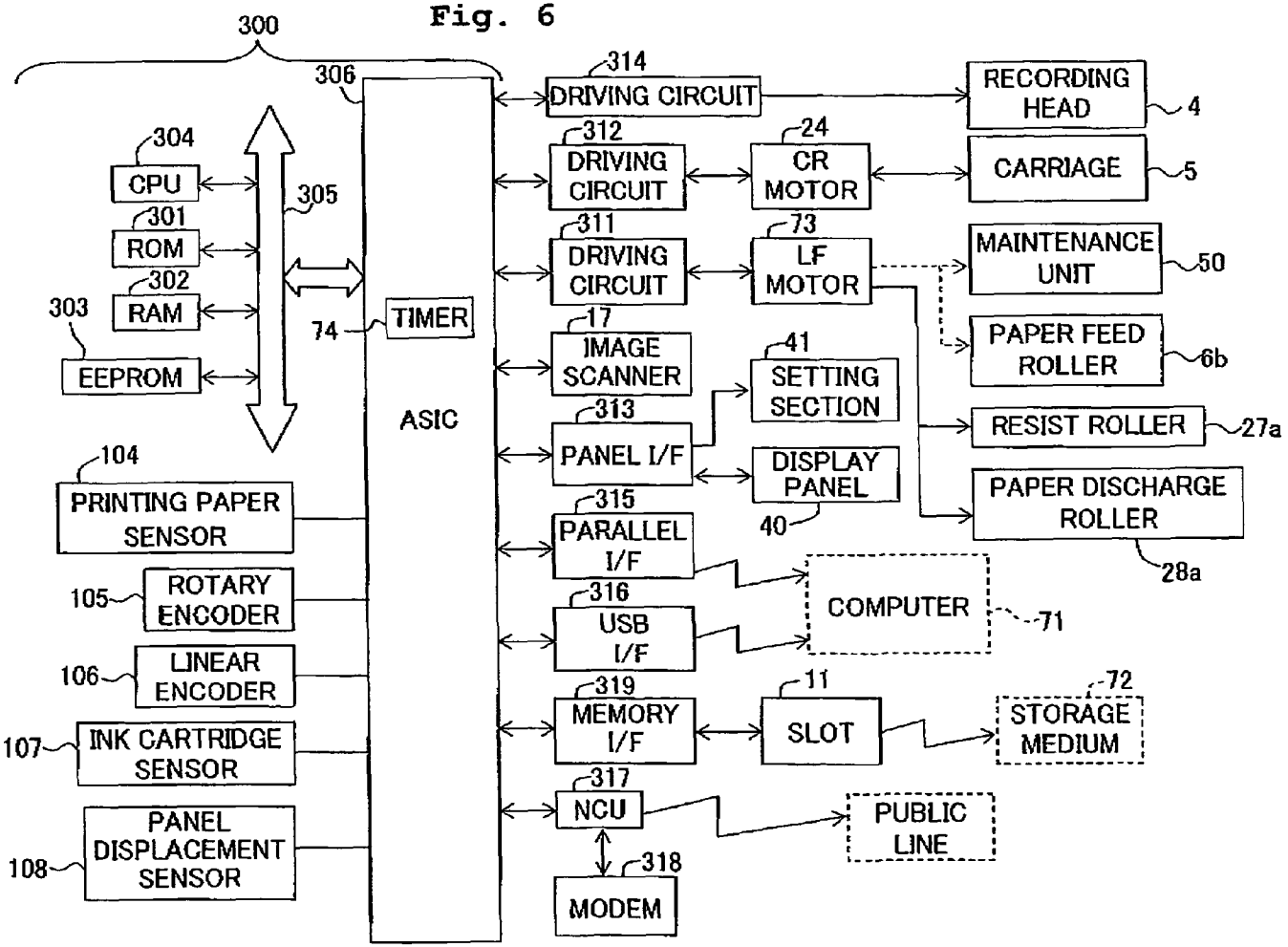
FIG. 6 shows a block diagram illustrating a control system.

The multi function device 1 is connectable to a computer 71 such as a personal computer and the telephone communication network, to which a storage medium 72 is detachably connected (see FIG. 6). The multi function device 1 is capable of recording the image (photograph and document) on the printing paper as the recording medium, on the basis of the image-data (including, for example, the photograph data and the document data) received, for example, from the computer 71, any other facsimile apparatus, and the storage medium 72 to be installed.

Figure 1:
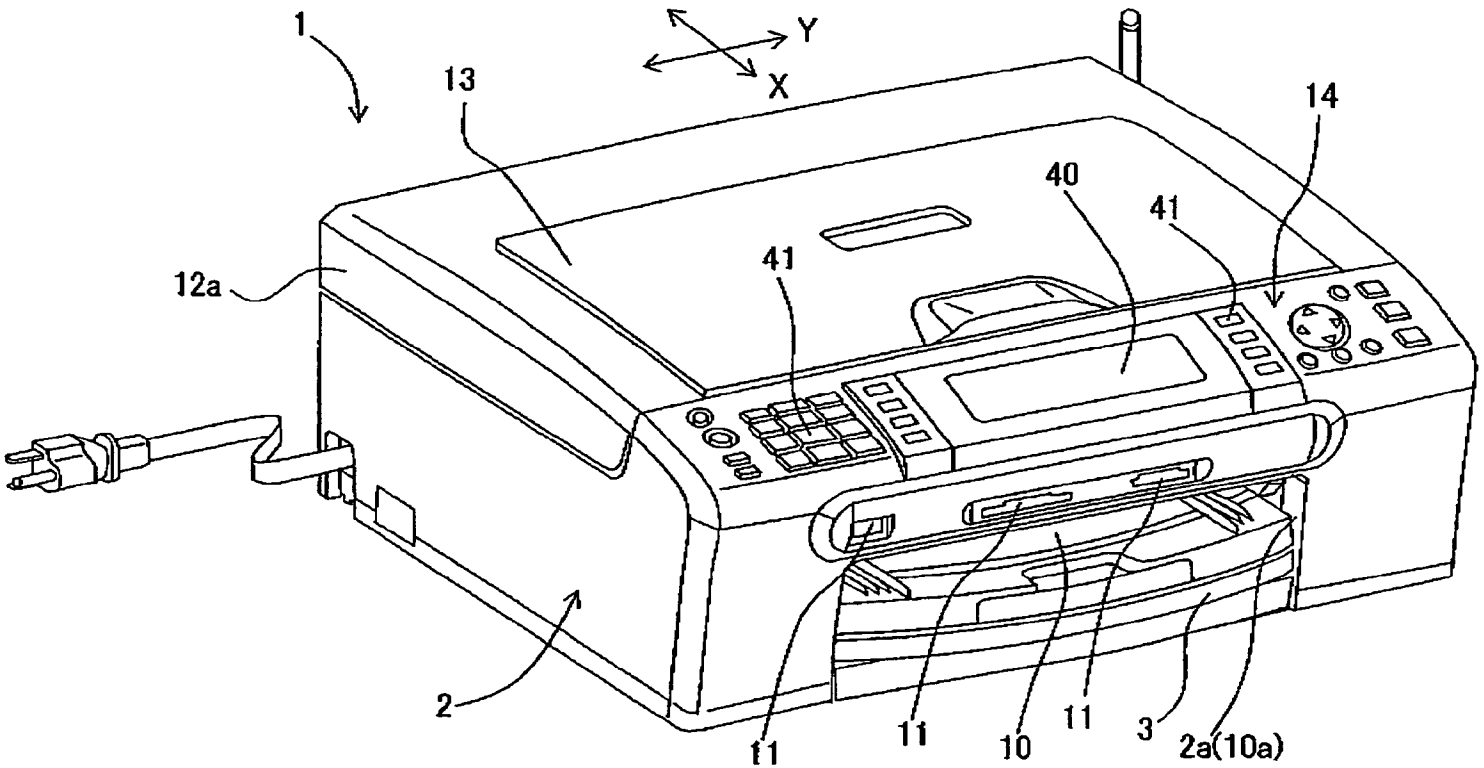
FIG. 1 shows a perspective view illustrating a multi function device to which the present invention is applied.
Figure 2:
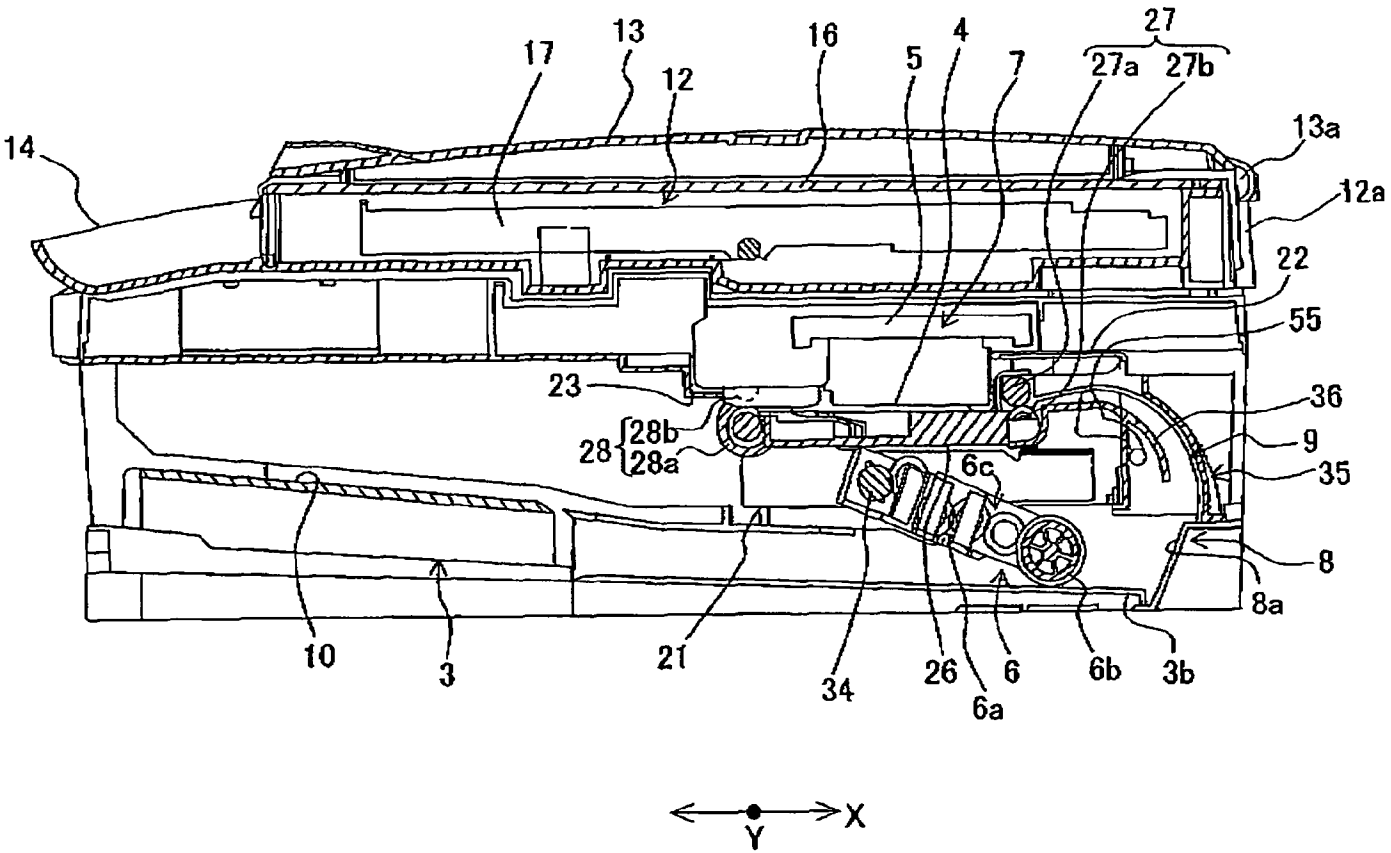
FIG. 2 shows a side sectional view illustrating the multi function device.
Figure 3:
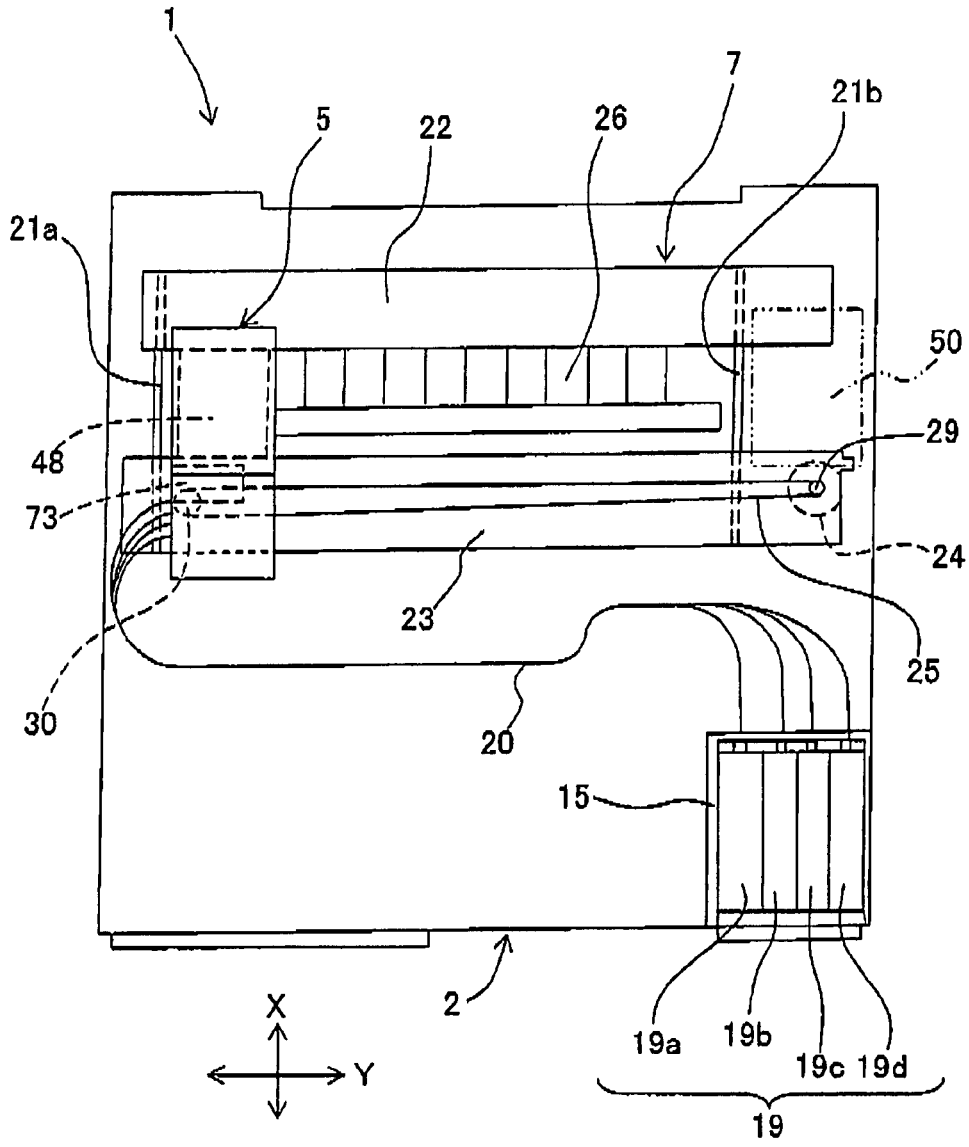
FIG. 3 shows a schematic plan view illustrating an arrangement of a recording section.

In this embodiment, as shown in FIGS. 2 and 3, a recording section 7 is provided in a main body case (housing) 2 as the main apparatus body. As shown in FIG. 1, a paper feed cassette device 3, which is insertable from an insert port 2*a* that is open at the front side of the main body case 2 (capable of being put in and out substantially in the horizontal direction), is arranged in an accommodating space at a bottom portion of the main body case 2. In the following description, the side, on which the insert port 2*a* of the main body case 2 is present, is referred to as "front", and the other sides are referred to as "back (backward)", "left", and "right" of the device or apparatus on the basis of the "front".

Slots (external input terminals) 11 are provided at the front surface of the main body case 2. Various types of storage media 72 (see FIG. 6), in which, for example, the image data and the control data for controlling the image recording are recorded, can be installed to the slots 11.

Various card-shaped media, each of which is composed of, for example, a semiconductor memory, are commercially available as the storage medium capable of being installed. The slots 11, which have three different sizes as shown in FIG. 1, can be adapted to the media having various sizes. A controller 300, which includes, for example, CPU 304 shown in FIG. 6 as described later on, is capable of detecting whether or not the storage medium 72 is installed to the slots 11.

As shown in FIG. 2, an image reading device (scanner) 12, which is provided, for example, in order to read the manuscript in the copy function and the facsimile function, is arranged in an image reading section case 12*a* at an upper portion of the main body case 2.

An operating section 14 is provided in front of the image reading device 12 on the upper side of the main body case 2. The operating section 14 includes a setting section 41 to which a user executes the various setting for the multi function device 1, and a display panel 40 to display various pieces of information for the user. The recording section 7, a paper discharge tray section 10, and other components are arranged in the projection area of the image reading device 12 and the operating section 14 as viewed in a plan view.

An accommodating section 15, which accommodates ink cartridges 19 (for four colors of yellow, magenta, cyan, and black in this embodiment, as individually affixed with 19*a* to 19*d*), is contained at a portion on one side of the paper discharge tray section 10 (right side as shown in FIGS. 1 and 3) on the front side of the main body case 2. The inks contained in the respective ink cartridges 19*a* to 19*d* are supplied to the recording head 4 independently respectively via flexible ink supply tubes (tubes) 20.

A placing glass plate 16, on which the manuscript can be placed, is provided on the upper surface of the image reading device 12. An image scanner device 17 is provided on the lower side thereof to read the manuscript. The image scanner device 17 is provided so that it reciprocates in the direction (scanning direction of the carriage 5, Y axis direction) perpendicular to the plane of the paper as viewed in FIG. 2. A manuscript cover member 13, which covers the placing glass plate 16, is attached openably/closably with respect to the image reading section case 12*a* by the aid of a hinge 13*a* at the backward end thereof (on the right side as viewed in FIG. 2).

As shown in FIG. 2, the recording section 7 is constructed such that various functional parts are supported by a frame-shaped main frame 21 having its open upper end. The main frame 21 is composed of a pair of left and right side plates 21*a*, 21*b*, and laterally long plate-shaped (plate-like) first and second guide members 22, 23 which are supported by the side plates and which extend in the Y axis direction (scanning direction). A carriage 5 is slidably supported while spanning the both guide members 22, 23. A platen 26, which supports the printing paper, is arranged facing the lower surface side of the recording head 4 carried by the carriage 5.

The carriage 5 is connected to a timing belt 25 which is arranged by being wound around pulleys 29, 30 on the upper surface of the second guide member 23. The carriage 5 reciprocates by driving the pulley 29 by means of a CR (carriage) motor 24.

A resist roller pair 27, which has both of the transport function and the resist function, is arranged on the upstream side from the platen 26 in the transport direction. The resist roller pair 27 is composed of a driving resist roller 27*a* and a driven roller 27*b*, which transports the printing paper to the gap between the platen 26 and the nozzle surface of the lower surface of the recording head 4. A paper discharge roller pair 28 is arranged on the downstream side from the platen 26. The paper discharge roller pair 28 is composed of a spur 28*b* which makes contact with the upper surface of the printing paper, and a driving paper discharge roller 28*a* which makes contact with the lower surface of the printing paper so that the printing paper having been recorded is transported to the paper discharge tray section 10.

An inclined plate 8, which has an elastic separating pad 8*a* for separating the printing paper, is arranged on the backward side (backward end side, right side as viewed in FIG. 2) of the paper feed cassette device 3. A paper feed roller 6*b*, which is provided at the lower end of a paper feed arm 6*a* on the side of the main body case 2, is rotated by the aid of a gear transmission mechanism 6*c* from the side of a drive shaft 34. Accordingly, the printing paper sheets, which are accumulated in the paper feed cassette device 3, are transported one by one.

The transported printing paper is fed to the resist roller pair 27 via a U-turn pass (paper feed transport passage) 9 which has a laterally U-shaped form as viewed in a side view and which is constructed between an outer transport passage member 35 and the inner transport passage member 36. The printing paper, which is recorded in the recording section 7, is discharged onto the paper discharge tray 10 with its recording surface being directed upwardly. The paper discharge tray 10 is formed on the upper side of the paper feed cassette device 3. A paper discharge port 10*a* (upper portion of the insert port 2*a*, see FIG. 1), which is communicated with the paper discharge tray 10, is open toward the front surface of the main body case 2.

A detecting or sensing lever 55, which transverses the paper feed transport passage 9 and which is rotatable, is provided on the downstream side of the paper feed transport passage (U-turn pass) 9. The detecting lever 55 detects or senses the passage of the forward end edge and the backward end edge of the printing paper passed through the paper feed transport passage (U-turn pass) 9 (see FIG. 2).

An ink-receiving section 48 on one end side (at a portion close to the left side plate 21*a* as shown in FIG. 3) and a maintenance unit 50 on the other end side (at a portion close to the right side plate 21*b* as shown in FIG. 3) are arranged respectively as the restoring mechanism at the outside of the width of the printing paper to be transported.

The ink-receiving section 48 is provided corresponding to the flashing position of the carriage 5. The recording head 4 periodically performs the ink discharge (flashing) in order to avoid the clog-up of the nozzles at the flashing position during the recording operation. The ink is received by the ink-receiving section 48.

Figure 4:
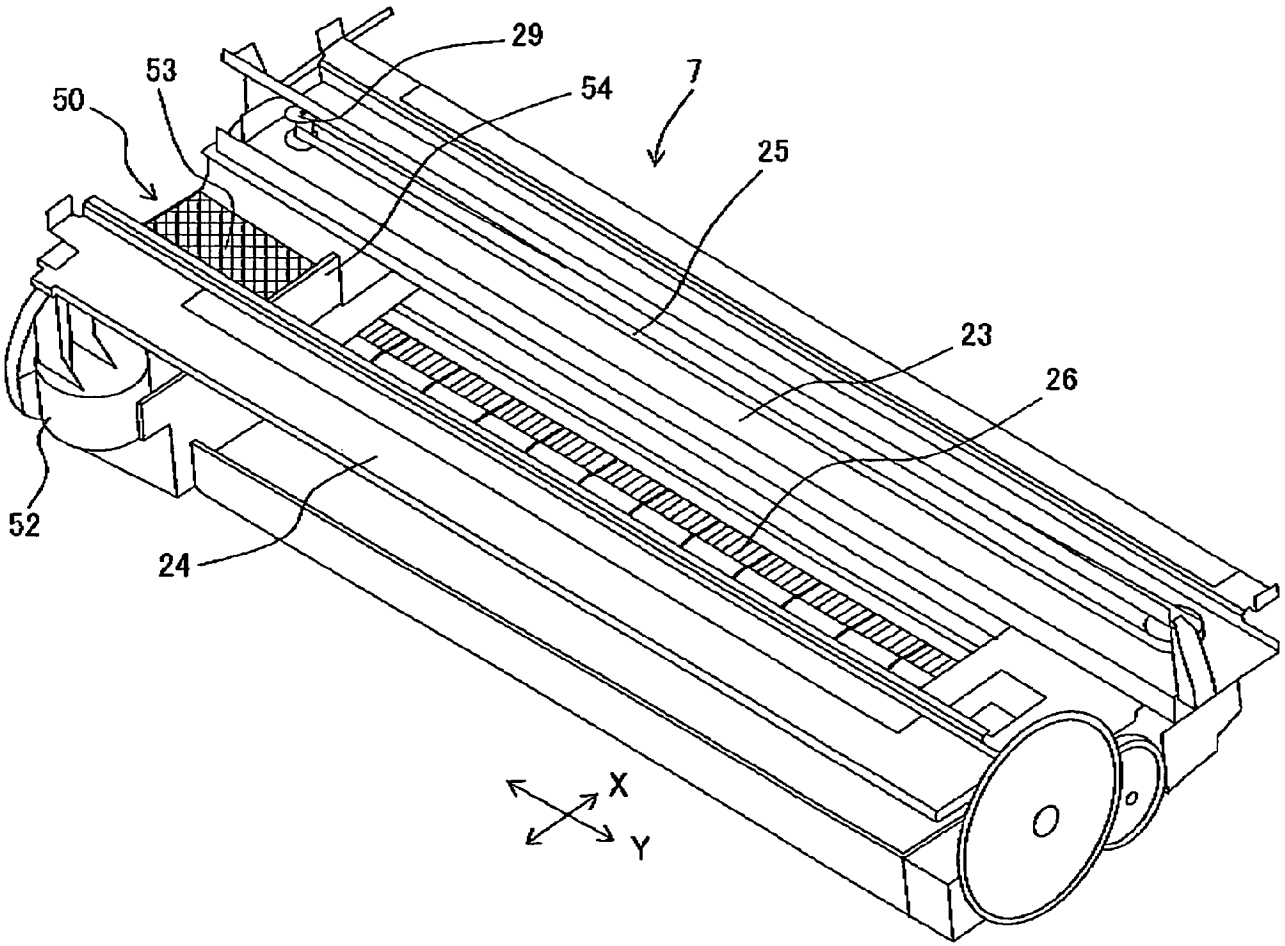
FIG. 4 shows a perspective view illustrating the recording section as viewed from the back surface side.
Figure 5:
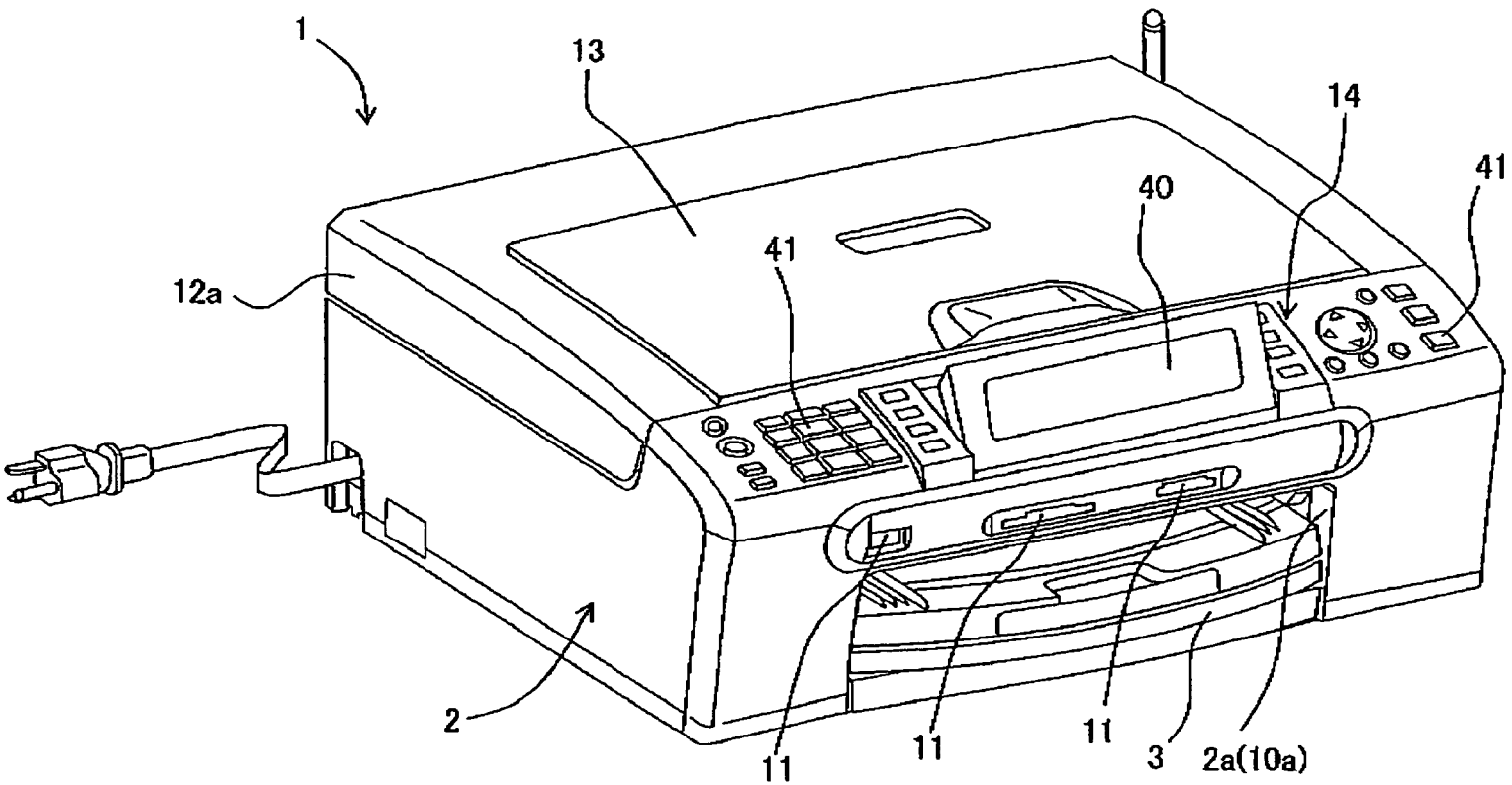
FIG. 5 shows a perspective view illustrating the multi function device in a state in which the angle of a panel section is adjusted

The maintenance unit 50 is provided corresponding to the waiting position (home position) of the carriage 5. The maintenance unit 50 performs the sucking restoring operation (purging) for the recording head 4. The maintenance unit 50 is provided with a cap 53 which is connected to the pump 52 statically placed on the main body frame 2, and a wiper 54 which wipes the nozzle surface (see FIG. 4).

In the restoring operation, a plurality of operations are performed singly or in combination. At first, the nozzle surface of the recording head 4 is covered with the cap 53 to suck the bubbles contained in the ink as well together with the dried or viscous ink from the nozzles of the recording head 4. When the cap 53 is separated from the nozzle surface, and the carriage 5 is moved in the direction toward the image recording area from the portion of the maintenance unit 50, then the cleaning is performed for the nozzle surface of the recording head 4 by means of the wiper 54. In other words, the cleaning is performed for the nozzle surface of the recording head 4 by moving the recording head 4 relatively with respect to the wiper 54. On the other hand, one of the restoring operations is also performed such that the carriage 5 is moved to the flashing position, and the recording head 4 is driven irrelevant to the recording operation to discharge the ink to the ink-receiving section 48.

The restoring operation can be adjusted depending on the condition including, for example, the elapsed time elapsed after the previous execution of the restoring operation as described later on. In this embodiment, the operation, in which the recording head is covered with the cap 53, the suction is effected by the pump 52, and the cap is separated, is defined as a series of the restoring operation. The restoring operation can be adjusted by changing the number of repetition of the series of the restoring operation, in other words, the number of times of suction with the pump 52. On the other hand, the restoring operation can be also regulated by controlling the length of the suction time of the pump 52.

An LF (printing paper feed or leaf feed) motor 73 (see FIGS. 3 and 6) serves as the driving source for the rotary driving of the pump 52 of the maintenance unit 50 and for the operations of the cap member 53 and the wiper 54 to make contact with or separation from the nozzle surface. The paper feed roller 6*b* of the paper feed mechanism 6, the resist roller 27*a*, and the paper discharge roller 28*a* can be also driven in addition to the maintenance unit 50 by switching the direction of rotation of the LF motor 73.

The operating section 14 will be explained. The operating section 14 is provided to have approximately the same width as the lateral width of the multi function device 1 on the upper front side of the main body case 2. The operating section 14 is arranged in an inclined form in which the front portion descends as a whole so that the operating section 14 is easily usable by the user. A display panel 40 having a liquid crystal screen is arranged at a central portion of the operating section 14. The backward end portion of the display panel 40 is capable of making the rotary movement in the vertical direction by the aid of a hinge provided at the front end side thereof. The angle of the display panel 40 can be adjusted or regulated so that the user can view the display panel 40 with ease. When the angle of the display panel 40 is adjusted, the detection is performed by a panel displacement sensor 108 (detecting section) shown in FIG. 6 contained in the apparatus. In other words, the adjustment of the angle of the display panel 40 is detected by the panel displacement sensor 108 as the event which causes the change in the rising/falling angle of the display panel 40 with respect to the multi function device 1, and the event is transmitted to the controller 300 as described later on. The panel displacement sensor 108 is preferably a sensor of the contact type (pressure type). However, it is also allowable to adopt those of any other system including, for example, an optical type sensor.

For example, a plurality of buttons and ten keys, which serve as the setting section 41 for the user to select and/or set, for example, the various functions (operations) provided for the multi function device 1, are arranged on the both sides to interpose the display panel 40 of the operating section 14. Those arranged as the buttons include function keys which are explicitly indicated as "Fax", "scan", "Copy", and "Digital Camera Print". Any one of the facsimile function, the scan function, the copy function, and the function to print the image data stored in the installed storage medium is selected and executed by depressing the function key. Other than the above, a button to instruct the restoring operation for the recording head is also prepared. An image scroll button and a select button are also included in the buttons provided on the setting section 41. The operation can be also instructed by selecting and/or setting the item displayed on the display panel 40.

The situation of the operation of the multi function device 1 is displayed on the display panel 40. When the various buttons of the setting section 41 are operated to instruct the operation, the display of the display panel 40 is changed into the content corresponding to the operation. However, as described later on, even when the user does not perform the button operation, the screen is changed in some cases in accordance with an event which causes the change in the display panel 40. For example, the multi function device 1 is provided with the facsimile function, and hence the multi function device 1 always connected to the power source. The display panel 40 can change the content of the screen depending on the receiving of the facsimile data (image data). In other words, the display content of the display panel 40 is changed by detecting, by the controller 300 (detecting section) as described later on, the event which causes the change of the display on the display panel 40, i.e., the fact that the facsimile data is received.

When the facsimile data is received, the multi function device 1 displays, on the display panel 40, the fact that the facsimile data is received, without immediately performing the recording on the printing paper by the recording section 7. This display is made with letters or any schematic graphic in some cases, or this display is made by the change of the color of the screen of the display panel 40 (for example, the change of the background color and/or the flashing) in other cases. After that, when the user performs the button operation, then the content of the received facsimile data is monitor-displayed as the image, and the display is made for the user to facilitate the selection of whether or not the printing is performed on the recording paper. Accordingly, the user can perform the recording on the printing paper only when the recording is necessary, after the user confirms the content of the facsimile data. Therefore, it is possible to eliminate any useless consumption of the printing paper.

The monitor display with the image of the content of the received facsimile data can be previously set by the user in the facsimile function. The monitor display is not set depending on the intension of the user in some cases. In such a situation, the recording operation is necessarily performed in succession after all of the receiving of the facsimile data is completed. However, the display content of the display panel 40 is changed in order to inform the receipt of the facsimile data at least at the point of time of the receiving the facsimile data (before performing the recording operation).

The display content of the display panel 40 are also changed as follows. That is, when the storage medium 72 (see FIG. 6) is inserted into the slots 11, the installation is displayed on the display panel 40. In other words, the display content of the display panel 40 is changed by detecting, by the controller 300 (detecting section) as described later on, the event which causes the change in the display content of the display panel 40, i.e., the fact that the storage medium 72 is inserted into the slots 11. In this situation, the image data, which is stored in the storage medium 72, is immediately subjected to the reduction (monitor) display on the display panel 40 without intervening the computer 71. Alternatively, the reduction display is made by operating the button by the user. The display to facilitate the selection of whether or not the image data is recorded on the printing paper is made together with the image. When a large number of photograph data are recorded as the image data, a list of images is displayed. The data can be also recorded on the printing paper by depressing the button of "Digital Camera Print" after selecting the desired image data from the large number of data, for example, with the select button.

Next, the controller 300 of the image recording apparatus 1 will be explained with reference to FIG. 6. The controller 300 controls the overall operation of the image recording apparatus 1.

The controller 300 (detecting section) is principally composed of a microcomputer which includes CPU 304, ROM 301, RAM 302, and EEPROM 303, and ASIC (Application Specific Integrated Circuit) 306 which is connected thereto via a bus 305. A timer 74, which measures the time T after elapsed the previous execution of the restoring operation by the maintenance unit 50 as described above, is contained in ASIC 306 or the microcomputer.

For example, programs, which control the various operations of the multi function device 1, are stored in ROM 301. RAM 302 is used as a working area and a storage area in which various data are temporarily stored to be used when CPU 304 executes the programs.

NCU (Network Control Unit) 317 is connected to ASIC 306. The communication signal, which is inputted via NCU 317 from the public line (PSTN), is demodulated by a modem 318, and then the communication signal is inputted into ASIC 306. When ASIC 306 transmits the image data to the outside by means of, for example, the facsimile communication, then the image data is modulated into the communication signal by the modem 318, and the communication signal is outputted via NCU 317 to the public line. In other words, NCU 317 and the modem 318 function as the communication section of the multi function device 1.

ASIC 306 generates, for example, the phase excitation signals to apply the electricity to the respective motors in accordance with the instruction from the microcomputer, and the signals are applied to the driving circuit 311 for the LF motor 73 and the driving circuit 312 for the CR motor 24 to control the LP motor 73 and the CR motor 24.

Further, those connected to ASIC 306 include, for example, the image scanner device 17 for reading the manuscript, a panel interface 313 provided with the setting section 41 and the display panel 40 for the various operations, a parallel interface 315 and a USB interface 316 for sending and receiving the data via the parallel cable and the USB cable with respect to the external equipment such as the personal computer 71, and a memory interface 319 provided with the slots 11 as the external input terminals to which the storage medium 72 are installed.

Further, those connected to ASIC 306 include, for example, a printing paper sensor 104 provided in relation to the detecting lever 55 (see FIG. 2) provided on the downstream side in the transport direction of the paper feed transport passage 9, a rotary encoder 105 for detecting the amount of rotation of the resist roller 27, a linear encoder 106 for detecting the amount of movement of the carriage 5, an ink cartridge sensor 107 for detecting the fact that the ink cartridge 19 is exchanged, and a panel displacement sensor 108 for detecting the fact that the angle of the display panel 40 is adjusted (see FIG. 6).

The driving circuit 314 is provided in order that the ink is selectively discharged onto the printing paper at the predetermined timing from the recording head 4. The driving circuit 314 drives and controls the recording head 4 by receiving the signal generated and outputted by ASIC 306 on the basis of the driving control procedure outputted from the microcomputer.

Next, an explanation will be made about the contents of the restoring operation stored in ROM 301. A table shown in FIG. 7 is stored in ROM 301. The specified numerical values shown in the table are provided by way of example, which may be appropriately changed depending on, for example, the arrangement of the recording head 4 and the maintenance unit 50 and the ability of the pump.

T represents the elapsed time period (count value) measured by the timer 74 from the previous execution of the restoring operation. The "number of times of purging" shown in the table indicates the number of times of repetition of the series of the restoring operation in which the recording head 1 is covered with the cap to be sucked with the pump.

In this embodiment, the setting is made as follows. That is, the elapsed time T from the previous execution of the restoring operation is compared with predetermined time periods stored in the table. The number of times of purging is set to once if the elapsed time T is above 5 days and not more than 10 days. The number of times of purging is set to twice if the time T is above 10 days and not more than 15 days. The number of times of purging is set to three times if the time T is above 15 days. Further, the number of times of purging is set to once in the case of the restoring operation (referred to as "ordinary purging") to be performed by being designated by the user. It is also allowable that the flashing, in which the ink is discharged from the recording head irrelevant to the recording operation, is performed in place of or continuously to the restoring operation in which the suction is performed by the pump.

Next, an explanation will be made with reference to flow charts shown in FIGS. 8 and 9 about the control in relation to the restoring operation of the multi function device 1.

When the multi function device 1 is in the waiting state in which any operation is not executed, if it is detected that the change arises in the angle or the display content of the display panel 40 on the basis of the program of the microcomputer (Yes in S101), then this fact is judged to be the change (sign or omen) prior to the execution of the recording operation by the recording section 7, and the restoring process (S102) as a subroutine is executed. Details of the restoring process will be described later on. However, it is judged whether or not the restoring operation is required for the recording head 4, and the routine returns to the main routine shown in FIG. 8 after starting the restoring operation or without starting the restoring operation.

When the multi function device 1 executes any operation, the situation of the operation is displayed on the display panel 40. Further, as described above, the display panel 40 changes the display content on the basis of the program of the microcomputer by receiving the facsimile data or by operating the button by the user so that the received facsimile data is monitor-displayed. Further, the display panel 40 changes the display content on the basis of the program of the microcomputer by inserting the storage medium 72 into the slots 11 or by operating the button by the user so that the image data in the storage medium 72 is monitor-displayed. Further, the display panel 40 also changes the display content when the user makes any operation for the setting section 41.

When it is displayed on the display panel 40 that the facsimile data (image data) is received, or when the user monitor-displays the content thereof on the display panel 40, then the recording instruction is given thereafter in many cases. When the storage medium 72 is inserted into the slots 11, or when the user monitor-displays the content thereof on the display panel 40, then the recording instruction is given thereafter in many cases.

Therefore, the change of the display content of the display panel 40, which is caused by the receiving of the facsimile data (image data), the insertion of the storage medium 72 into the slots 11, or the operation for the setting section 41 to monitor-display the content thereof, can be used for the judgment as one of the changes prior to the recording operation.

The angle of the display panel 40 with respect to the multi function device 1 is adjusted by the user so that the display panel 40 is viewed with ease. Therefore, when the angle of the display panel 40 is adjusted, it is assumed that the user subsequently instructs any operation while viewing the display on the display panel 40, which can be also used for the judgment as one of the changes prior to the recording operation.

Even when no change arises in the angle or the display content of the display panel 40 (No in S101), it is a matter of course that the restoring process (S104) of the subroutine is executed, if the restoring operation is instructed by the user (if the user operates, for example, the button exclusively provided for the restoring operation) (Yes in S103). Even when the restoring operation is not instructed by the user (No in S103), if the recording operation is instructed by the user or the external equipment such as the personal computer 71 (Yes in S105), then the restoring process of the subroutine (S106) is executed, and the recording operation is performed (S107) after starting the restoring operation or without starting the restoring operation.

In S102 and S106 of the restoring process of the subroutine as described above, as shown in FIG. 9, the time period (count value) T, which is measured by the timer 49 from the previous execution of the restoring operation, is firstly detected (S201). It is judged whether or not the count value T is above 5 days (S212). If the count value is not above 5 days (No in S212), then it is judged that the execution of the restoring operation is unnecessary, and the restoring process is completed to return to the main routine.

If the count value T is above 5 days and not more than 10 days (Yes in S212 and No in S213), then the "number of times of purging: once" is read from the table shown in FIG. 7, and the series of restoring operation is executed once (S214). If the count value T is above 10 days and not more than 15 days (Yes in S213 and No in S215), then the "number of times of purging: twice" is read from the table, and the series of restoring operation is executed twice (S216). If the count value T is above 15 days (No in S216), then the "number of times of purging: three times" is read from the table, and the series of restoring operation is executed three times (S217).

Figure 8:
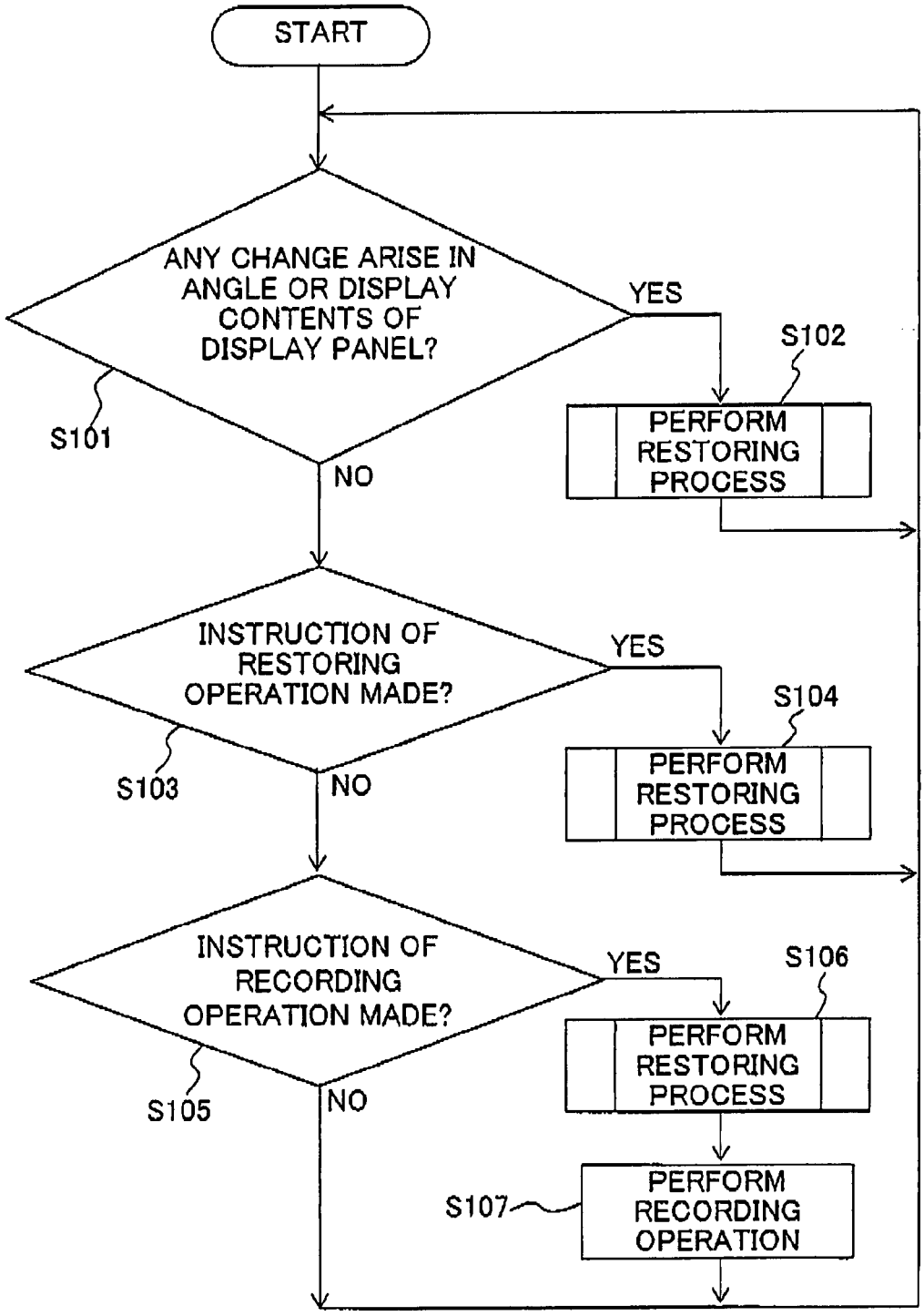
FIG. 8 shows a flow chart illustrating a main routine of the restoring operation of the multi function device.
Figure 9:
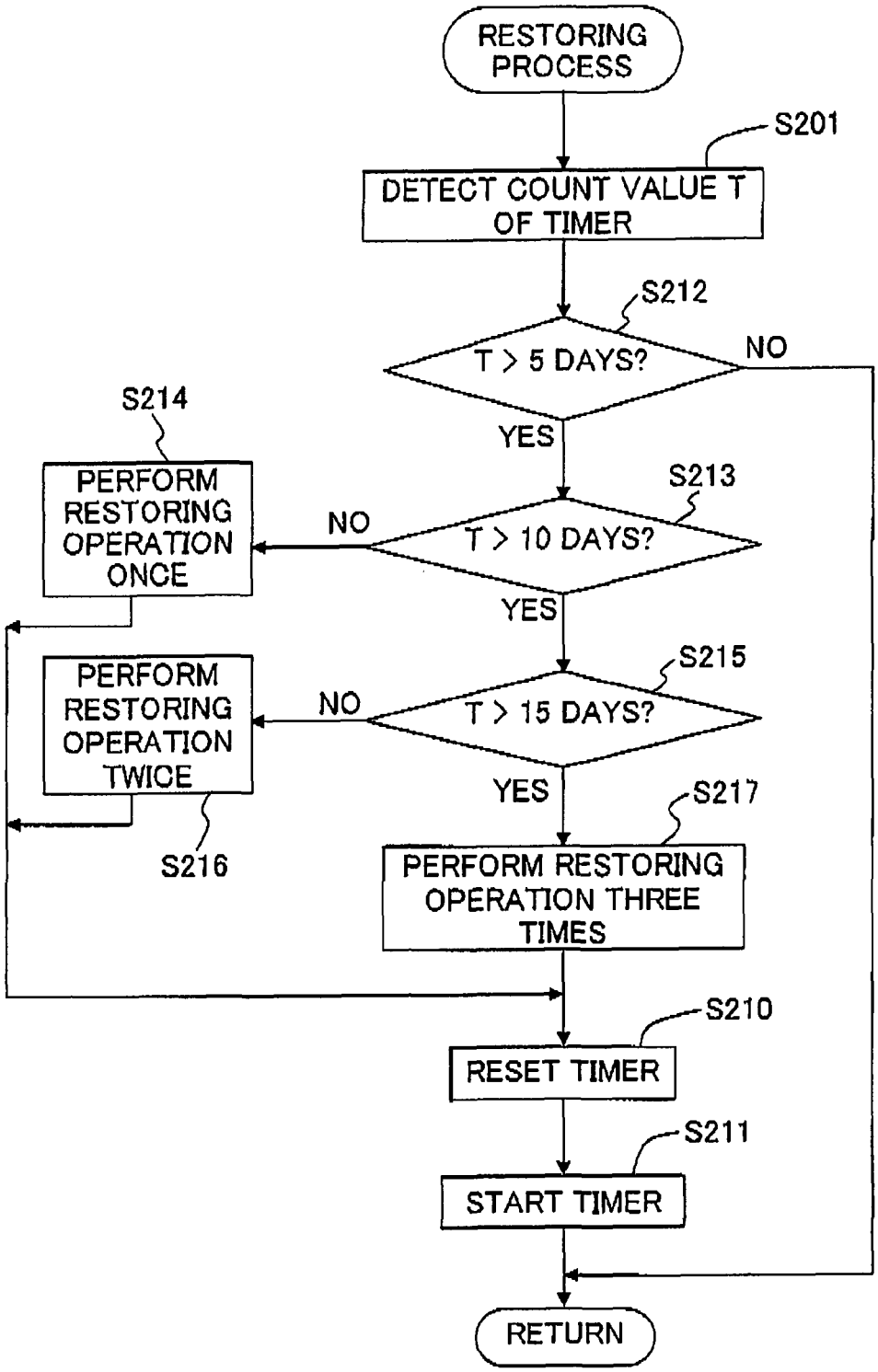
FIG. 9 shows a flow chart illustrating a restoring process.

If the restoring operation is completed (S214, S216, S217), then the count value T of the timer 74 is reset (S210), and the count of the timer 74 is started again (S211) to return to the main routine shown in FIG. 8.

S104 of the restoring process of the subroutine is the process which is forcibly performed by the user. Therefore, the restoring operation is performed only once without changing the control depending on the count value T as shown in FIG. 9. After that, the count value T of the timer 74 is reset, the count of the timer 74 is started again, and the routine returns to the main routine shown in FIG. 8.

As described above, in the case of the multi function device 1 of the present invention, if the change in relation to the angle or the display content of the display panel 40 (S101) arises before the instruction of the recording operation, it is judged that the sign of the instruction of the recording operation is provided. The change is caused, for example, by the receiving of the facsimile data or the insertion of the storage medium 72 into the slot section 11 as described above. It is immediately judged whether or not the multi function device 1 is in the state in which the restoring operation is required (whether or not the predetermined time period elapses after the previous restoring operation). If necessary, the restoring operation is started. After that, if the instruction is made (S105) for the recording operation for the facsimile data or the image data of the storage medium 72, then it is possible to shorten the time period required until the completion of the recording, and it is possible to dissolve the inconvenience of the user, because the restoring operation has been already completed or the restoring operation is in execution, as compared with a case in which the restoring operation is performed after the recording operation is instructed as performed in the conventional technique.

The restoring operation is adjusted depending on the length of the elapsed time elapsed after the previous restoring operation. Therefore, the ink is not unnecessarily consumed in the restoring operation, and the state of the recording head can be satisfactorily restored in the reliable manner.

As for the control shown in FIG. 8 in which the changeover is made to the purge process when the change arises in the display panel 40 (S101), it is also allowable that whether or not the setting is made to perform the control can be set by the user.

The following procedure may be also adopted without any problem. That is, when the multi function device is in the waiting state in which the multi function device is not operated for a long period of time, the display may be made while lowering the luminance without changing the display content on the display panel 40 in order to save the electric power consumption. In this case, the decrease in the luminance is not regarded as "change arises" in S101 shown in FIG. 8. The "change arises" in S101 shown in FIG. 8 is the active change which involves the possibility to subsequently perform the recording operation.

In the flow shown in FIG. 8 of this embodiment, it is judged whether or not the instruction of the restoring operation is made (S103). If the instruction of the restoring operation is not made, it is judged whether or not the instruction of the recording operation is made (S105). However, even if this sequence is reversed, an effect, which is the same as or equivalent to that of this embodiment, is obtained. That is, it may be judged whether or not the instruction of the recording operation is made. If the instruction of the recording operation is not made, it may be judged whether or not the instruction of the restoring operation is made. In this procedure, the subroutine after providing the instruction of the recording operation and the subroutine after providing the instruction of the restoring operation are the same as or equivalent to the subroutines adopted in this embodiment respectively.

In this embodiment, it is detected that the angle of the display panel 40 with respect to the multi function device 1 is adjusted, by means of the panel displacement sensor 108. However, when the display panel 40 is a contact type panel, it is also allowable to further provide a sensor for detecting the fact that the user makes contact with the display panel 40. For example, when the display panel 40 is the contact type panel in which the function select screen is displayed as the display content for the user and the contact with the select screen by the user is detected, an effect, which is the same as or equivalent to the effect of this embodiment, can be also obtained by judging the fact that the user makes contact with the select screen of the display panel 40 as the sign of the recording operation to perform the restoring operation.

The embodiment of the present invention described above is illustrative of the case in which the present invention is applied to the ink-jet type recording apparatus wherein the recording head 4, which is carried on the carriage 5, reciprocates along the guide members 22, 23 together with the carriage 5. However, the flow of the restoring operation of the embodiment of the present invention can be also applied to any ink-jet recording apparatus having a line type head in which a plurality of nozzles are aligned in series in the scanning direction.

The embodiment of the present invention described above is illustrative of the case in which the image recording apparatus of the present invention is applied to the printing apparatus based on the ink-jet system in which the recording is performed by discharging the ink from the nozzles. However, the present invention is not limited thereto, which may be improved and modified within a range of the appended claims. For example, the liquid is not limited to the ink, and the present invention is also applicable to any recording apparatus to be used in a variety of fields including, for example, the medical and the analysis, provided that the apparatus is an image recording apparatus which requires the discharge of the viscous liquid contained in the head and/or the air contained in the liquid flow passage.

What is claimed is:

1. An image recording apparatus which records an image on a recording medium, the image recording apparatus comprising:

a recording section which records the image by discharging an ink from nozzles to the recording medium;

an operating section via which a user can select a desired operation from a plurality of operations including a recording operation performed by the recording section;

a display which displays a situation of the operation;

a restoring mechanism which performs a restoring operation for restoring a discharge state of the nozzles;

a timer which measures an elapsed time elapsed after execution of the restoring operation last time;

a communication section which transmits and receives facsimile data, wherein when the facsimile data is received by the communication section, a display content of the display is changed to display a receipt of the facsimile data or the received facsimile data;

a detecting section which monitors the display and actually detects change of a display content in the display; and a controller which controls the restoring mechanism to execute the restoring operation whenever the detecting section detects the change of the display content in the display caused by receiving of the facsimile data by the communication section and the elapsed time measured by the timer exceeds a predetermined time period.

2. The image recording apparatus according to claim 1; wherein a background color is changed on the display to display the receipt of the facsimile data.

3. The image recording apparatus according to claim 1; wherein the restoring mechanism adjusts the restoring operation depending on a length of the elapsed time measured by the timer.

4. The image recording apparatus according to claim 3; wherein the restoring mechanism includes a pump which sucks the ink from the nozzles of the recording section, and a cap which covers the nozzles.

5. The image recording apparatus according to claim 4; wherein the restoring operation is adjusted by a number of times of suction of the ink from the nozzles of the recording section.

6. The image recording apparatus according to claim 4; wherein the restoring operation is adjusted by a length of time period of suction of the ink from the nozzles of the recording section.

7. The image recording apparatus according to claim 3; wherein the restoring operation includes a sucking restoring operation for the recording section, and an operation for driving the recording section irrelevant to the recording operation to discharge the ink.

8. The image recording apparatus according to claim 7; wherein the sucking restoring operation includes an operation in which a nozzle surface formed in the recording section is wiped out by moving the recording section relatively with respect to a wiper for wipes the nozzle surface.

9. The image recording apparatus according to claim 1; wherein the operating section includes a button via which the user selects or sets the operation of the image recording apparatus.

10. The image recording apparatus according to claim 9; wherein the operation of the image recording apparatus includes the restoring operation for the recording section.

11. An image recording apparatus which records an image on a recording medium, the image recording apparatus comprising:

a recording section which records the image by discharging an ink from nozzles to the recording medium;

an operating section via which a user can select a desired operation from a plurality of operations including a recording operation performed by the recording section;

a display which displays a situation of the operation;

a restoring mechanism which performs a restoring operation for restoring a discharge state of the nozzles;

a timer which measures an elapsed time elapsed after execution of the restoring operation last time;

an external input terminal to which a storage medium is installable, wherein image data or the like is stored in the storage medium and when the storage medium is installed to the external input terminal, a display content of the display is changed to display an installation of the storage medium or to display the image data stored in the storage medium;

a detecting section which monitors the display and actually detects change of a display content in the display; and a controller which controls the restoring mechanism to execute the restoring operation based on the detecting section detecting the change of the display content in the display caused by installation of the storage medium to the external input terminal and the elapsed time measured by the timer exceeding a predetermined time period.

12. The image recording apparatus according to claim 1; wherein the controller controls the restoring mechanism to execute the restoring operation after the communication section receives the facsimile data and before the recording section records the image on the recording medium based on the facsimile data.

* * * * *